US006475261B1

(12) United States Patent
Matsumoto et al.

(10) Patent No.: US 6,475,261 B1
(45) Date of Patent: Nov. 5, 2002

(54) NIMNGA ALLOY WITH A CONTROLLED FINISH POINT OF THE REVERSE TRANSFORMATION AND SHAPE MEMORY EFFECT

(76) Inventors: Minoru Matsumoto, 22-17, Nankoudai 6-chome, Izumi-ku, Sendai-shi, Miyagi (JP); Junji Tani, 5-11, Tori-cho 1-chome, Aoba-ku, Sendai-shi, Miyagi (JP); Toshiyuki Takagi, 38-15, Midorigaoka 3-chome, Taihaku-ku, Sendai-shi, Miyagi (JP); Kiyoshi Yamauchi, c/o Tokin Corporation, 7-1, Koriyama 6-chome, Taihaku-ku, Sendai-shi, Miyagi (JP)

( * ) Notice: Subject to any disclaimer, the term of this patent is extended or adjusted under 35 U.S.C. 154(b) by 0 days.

(21) Appl. No.: 09/236,245

(22) Filed: Jan. 25, 1999

Related U.S. Application Data

(63) Continuation of application No. 08/853,318, filed on May 8, 1997, now abandoned.

(30) Foreign Application Priority Data

Mar. 19, 1997 (JP) ..... 9-67046

(51) Int. Cl.[7] ..... B22F 9/00

(52) U.S. Cl. ..... 75/245; 419/245; 148/312; 148/409; 148/426; 420/459

(58) Field of Search ..... 148/312, 409, 148/426; 420/459; 419/38; 75/245

(56) References Cited

PUBLICATIONS

Wirth et al., Structural and Magnetic Properties of Ni2MnGa, J. Mag. Mat., 167:L–7–L11, Mar. 1997.*

Cherneko et al., The Development of New Ferromagnetic Shape–Memory Alloys in Ni2MnGa system, Scripta Metalurg., 33:1239–1244, Mar. 1997.*

* cited by examiner

*Primary Examiner*—John Sheehan
(74) *Attorney, Agent, or Firm*—Morgan, Lewis & Bockius LLP

(57) ABSTRACT

In an NiMnGa alloy represented by the chemical formula of $Ni_{2+X}Mn_{1-X}$ Ga, a composition ratio parameter X (mol) is selected within a range of $0.10 \leqq X \leqq 0.30$. With this composition, the finish point of the reverse transformation of the martensitic transformation can be selected to a desired temperature within the range between −20° C. and 50° C., while the Curie point is also selected to a desired temperature within the range between 60° C. and 85° C. The alloy has the shape memory effect by the martensitic transformation and the reverse transformation. Furthermore, the alloy is induced with the reverse transformation by application of an external magnetic field at the martensite phase to exhibit the shape recovery.

7 Claims, No Drawings

NIMNGA ALLOY WITH A CONTROLLED FINISH POINT OF THE REVERSE TRANSFORMATION AND SHAPE MEMORY EFFECT

This is a continuation of patent application no. 08/853,318, filed on May 8, 1997, now abandoned.

BACKGROUND OF THE INVENTION

This invention generally relates to a shape memory alloy and, in particular, to an NiMnGa magnetic alloy having a shape memory effect.

In general, it is known that a shape memory alloy, such as a TiNi alloy or a CuZn alloy, exhibits a remarkable shape memory effect and a superelasticity.

Such an alloy has an austenite phase at a relatively high temperature and a martensite phase at a relatively low temperature. Upon the temperature drop of the alloy from the relatively high temperature to the relatively low temperature, the alloy phase transforms or transforms from the austenite phase to the martensite phase. The phase transformation is called the martensitic transformation. On the other hand, the other reverse phase transformation from the martensite phase to the austenite phase accompanied with temperature elevation is referred to as an austenitic transformation. Since the austenitic transformation is the reverse transformation of the martensitic transformation and, it is often referred to as the reverse transformation.

Providing that the alloy is formed into a shape as an original shape at the austenite phase and then cooled without deformation of the original shape into the martensite phase, the alloy is deformed from the original shape into a desired shape at the martensite phase. Thereafter, when the alloy is exposed to a temperature elevation and transformed to the austenite phase, the alloy changes in shape from the desired shape into the original shape. The alloy has a shape recovery effect by the temperature elevation or the reverse transformation. This means that the alloy memorises the original shape. That is, the alloy has the shape memory effect.

On the temperature axis for the both phase transformation, the alloy has a start point and a finish point of the martensitic transformation which will be referred to as $M_s$ point and $M_f$ point, respectively, and also a start point and a finish point of the austenitic or reverse transformation which will be referred to as $A_s$ point and $A_f$ point, respectively. Both transformation have a hysteresis on the temperature axis, and therefore, $M_s$ point and $A_f$ point are not coincident with but different from each other, and $M_f$ point and $A_s$ point are not coincident with but different from each other, too.

The shape memory alloy as well as other metal has usually elasticity against a deformation or strain under a limited stress or strain which will be known as a yield point. A particular one of the shape memory alloy has a nature where it exhibits a large strain suddenly after exceeding the yield point and recovers from the strain to the original non-strain condition when the stress is unloaded. This nature is referred to as the super-elasticity. The superelasticity is usually present around the $A_f$ point or just above the $A_f$ point.

Among others, the TiNi alloy is known as an alloy having the most excellent shape memory effect and is widely used, for example, as temperature responsive actuators in a ventilator of a house, an air conditioner, a rice cooker, and a shower valve. The TiNi alloy has also excellent superelasticity and is used for an eyeglass frame, medical instruments such as a catheter, and an antenna of a mobile telephone.

On the other hand, an $Ni_2MnGa$ alloy is known as a magnetic alloy which has the martensitic transformation and the reverse transformation along the temperature drop and elevation, respectively. According to the martensitic and reverse transformation, the $Ni_2MnGa$ alloy is known to change in magnetism. That is, it is changed from paramagnetism into ferromagnetism at the $A_f$ point upon the reverse transformation from a low temperature phase into a Heusler type high temperature phase by temperature elevation. The $A_f$ point $Ni_2MnGa$ alloy is about −50° C. It should be noted that the $A_f$ point is different from the Curie point which is known as a point where the alloy changes in the magnetism from the ferromagnetism to the paramagnetism upon the further temperature elevation. Therefore, $Ni_2MnGa$ alloy exhibits the ferromagnetism within the temperature range between the $A_f$ point and the Curie point $T_c$ but is paramagnetism in the other temperature region. The Curie point of the $Ni_2MnGa$ alloy is about 105° C. In the present status, however, no technique has been found out to shift or control the $A_f$ point. Thus, it is impossible to use the $Ni_2MnGa$ alloy as functional elements such as temperature responsive magnetic elements which is operable around a normal living environment temperature, for example, −20° C. to +50° C.

Further, the $Ni_2MnGa$ alloy was believed to have no shape memory effect.

SUMMARY OF THE INVENTION

It is an object of this invention to provide an NiMnGa alloy which has a finish point ($A_f$) of the reverse transformation of the martensitic transformation around a normal living environment temperature and which is therefore applicable to temperature responsive elements.

According to this invention, there is provided an NiMnGa alloy represented by a chemical formula of $Ni_{2+X}Mn_{1-X}Ga$ ($0.10 \leqq X \leqq 0.30$ in mol) and having a finish point of the reverse transformation of the martensitic transformation at a temperature equal to −20° C. or more.

According to an aspect of this invention, the finish point can be selected at a temperature within a range between −20° C. and 50° C. with the Curie point at a temperature within a range between 60° C. and 85° C.

According to another aspect of this invention, there is also provided an NiMnGa alloy which has the shape memory effect accompanied with the martensitic transformation and the reverse transformation along the temperature variation.

According to another aspect of this invention, there is also provided an NiMnGa alloy which has a characteristic wherein the reverse transformation is induced by application of an external magnetic field at a condition of the martensite phase, to thereby cause a shape recovery.

DESCRIPTION OF THE INVENTION

Now, description will be made in detail as regards an NiMnGa alloy of this invention in conjunction with specific examples thereof.

At first, an outline of the NiMnGa alloy of this invention will be briefly described. This invention is based on the findings by the present inventors that, in the NiMnGa alloy, the finish point ($A_f$) of the reverse transformation can be shifted or controlled at a temperature within a predetermined range by changing composition ratio of Ni and Mn. The present inventors have also found out that the NiMnGa alloy exhibited the shape memory effect accompanied with the martensitic transformation and the reverse transformation.

Specifically, the NiMnGa alloy of this invention is characterized as follows. In the NiMnGa alloy represented by the chemical formula of $Ni_{2+x}Mn_{1-x}Ga$, a composition ratio parameter X (mol) is selected within the range of $0.10 \leqq X \leqq 0.30$. With this composition, the finish point $A_f$ of the reverse transformation can be selected to a desired temperature within the range between −20° C. and 50° C. while the Curie point $T_c$ being selected to a desired temperature within the range between 60° C. and 85° C. . Furthermore, it has been found out that the reverse transformation of martensitic transformation can be induced by application of an external magnetic field to the $Ni_{2+x}Mn_{1-x}Ga$ alloy and the shape recovery can thereby be performed.

Therefore, the NiMnGa alloy-according to this invention can be expected to be used onto various applications such as temperature and/or magnetic responsive elements under the normal living environment.

Now, examples of the NiMnGa alloy of this invention will be specifically described together with a method of manufacturing the same.

At first, in the NiMnGa alloy represented by the chemical formula of $Ni_{2+x}Mn_{1-x}Ga$, the composition ratio parameter X (mol) was selected to be various different values as shown in Table 1, and ten NiMnGa alloy ingots having the compositions were prepared by mixing materials of the alloy, melting the mixture by the argon arc method, and casting into the alloy ingots. Thereafter, the ingots were pulverized into NiMnGa alloy powder materials, respectively. These NiMnGa alloy powder materials were sieved under 250 mesh, compacted into a rode shape, and sintered at 800° C. for 48 hours. Thus, ten rod-like samples having a diameter ϕ of 5 mm were obtained.

Then, the rod-like samples were subjected to measurement of the $A_f$ point and the Curie temperature $T_c$. The result of measurement was shown in Table 1 together with the specific compositions of the NiMnGa alloy.

TABLE 1

| Sample No. | | X | $Ni_{2+X}Mn_{1-X}Ga$ | $A_f$ ° C. | $T_c$ ° C. |
|---|---|---|---|---|---|
| 1 | Comparative | 0 | $Ni_{2.0}Mn_{1.0}Ga$ | −50 | 105 |
| 2 | Examples | 0.02 | $Ni_{2.02}Mn_{0.98}Ga$ | −40 | 100 |
| 3 | | 0.05 | $Ni_{2.05}Mn_{0.95}Ga$ | −33 | 98 |
| 4 | This | 0.10 | $Ni_{2.10}Mn_{0.90}Ga$ | 0 | 85 |
| 5 | Invention | 0.16 | $Ni_{2.16}Mn_{0.84}Ga$ | 50 | 57 |
| 6 | | 0.20 | $Ni_{2.20}Mn_{0.80}Ga$ | 0 | 60 |
| 7 | | 0.25 | $Ni_{2.25}Mn_{0.75}Ga$ | −10 | 65 |
| 8 | | 0.30 | $Ni_{2.30}Mn_{0.70}Ga$ | −20 | 70 |
| 9 | Comparative | 0.40 | $Ni_{2.40}Mn_{0.60}Ga$ | −30 | 90 |
| 10 | Examples | 0.50 | $Ni_{2.50}Mn_{0.50}Ga$ | −50 | 100 |

From Table 1, the following is observed. In Samples Nos. 1–3 as comparative examples, the composition ratio parameters X (mol) are selected between 0 and 0.05. In these samples, the $A_f$ point ranges between −50° C. and −33° C. and the Curie point $T_c$ ranges between 98° C. and 1050° C. The $A_f$ point is excessively lower than the normal living environment temperature. The Curie point $T_c$ is also higher than the normal living environment temperature.

In Samples Nos. 4–8 according to the examples of this invention, the composition ratio parameters X (mol) are selected between 0.10 and 0.30. In these samples, the $A_f$ point ranges between −20° C. and 50° C. and the Curie temperature $T_c$ ranges between 57° C. and 85° C. Thus, the $A_f$ point falls within a temperature range of the normal living environment. The Curie point $T_c$ also falls within a temperature range above but near the normal living environment temperature.

Furthermore, in Samples Nos. 9–10 as comparative examples, the composition ratio parameters X (mol) are selected between 0.40 and 0.50. In these samples, the $A_f$ point ranges between −50° C. and −30° C. and the Curie point $T_c$ ranges between 90° C. and 100° C. Thus, the $A_f$ point is excessively lower than the normal living environment temperature. The Curie point $T_c$ is excessively higher than the normal living environment temperature.

Next, these samples were bent by an angle of about 10° at about a temperature of −200° C. by the use of liquid nitrogen. Thereafter, all samples were put into hot water of about 70° C. which is higher than the any temperatures as the $A_f$ point of the samples. Then, change in shape was observed whether or not the shape memory effect was caused.

As a result, Samples Nos. 4–8 of the embodiment exhibited shape recovery of an angle of 2–3° from the bent angle of about 10°. On the other hand, Samples Nos. 1–3 and 9–10 as the comparative examples exhibited no substantial shape-recovery.

Sample No. 5 having the $A_f$ point at a temperature of 50° C. was also bent at −200° C., and was applied with an external magnetic field of 5T at a-room temperature of about 20° C. so as to examine whether or not the reverse transformation is induced by the magnetic field application. As a result, the shape recovery of an angle of 2–30° was observed from the bent angle of 10° like the above described case. Thus, it was confirmed that the reverse transformation was induced by application of the magnetic field at the martensite phase.

The similar test was carried out for Sample No. 3 as the comparative example and Samples Nos. 4 and 8 according to the examples of this invention, except that the bending was performed at about −60° C. by the use of dry ice alcoholic solution. As a result, the reverse transformation was induced in the similar manner by applying the external magnetic field and the shape recovery was observed although it was not so sufficient.

From the above-mentioned results, it has been found out that Samples Nos. 4–8 of the examples of this invention have the finish point $A_f$ of the reverse transformation of the martensitic transformation within a temperature range of the normal living environment, while the Curie point $T_c$ falling in a temperature range above the neighborhood of the normal living environment temperature. Further, the samples Nos. 4–8 are induced the reverse transformation by application of external magnetic field at a temperature of the martensite phase, exhibit the shape memory effect to release a strain previously caused in the martensite phase.

What is claimed is:

1. A sintered magnetic NiMnGa alloy which is represented by the general formula $$Ni_{2+x}Mn_{1-x}Ga$$

in which x fulfills the relation: $0.10 \leqq x \leqq 0.30$ (in mol) and having a Curie point in the temperature range from 57° C. to 85° C. and a finish point (Af) to reverse transformation in a temperature range from −20° C. to 50° C. which has the shape memory effect accompanied with said martensitic transformation and the reverse transformation along the temperature variation is induced by application of an external magnetic field at the martensite phase.

2. The sintered magnetic NiMnGa alloy of claim 1, wherein x is 0.16, the finish point (Af) is 50° C., and the Curie point is 57° C.

3. A method for manufacturing the sintered NiMnGa alloy of claim 1, comprising the steps of:

providing and mixing the components of the alloy according to the relation specified in claim 1;

melting the mixture using the argon arc method;

casting the melted mixture into an alloy ingot;

pulverizing the ingot into a NiMnGa alloy powder;

sieving the alloy powder and compacting same into a rod-shape; and sintering the compacted rod at about 80° C. for about 48 hours.

4. A temperature and/or magnetic responsive element which is operable around a normal living environment temperature, which comprises the sintered NiMnGa alloy according to claim 1.

5. The temperature and/or magnetic responsive element of claim 4, wherein the operating temperature is in the range of −20 ° C. to 50° C.

6. A magnetic field-to-shape transducing element which is made of the sintered NiMnGa alloy according to claim 1, said element changing its shape in response to application of an external magnetic field.

7. The element according to claim 6, wherein said finish point (Af) is 50° C. and the Curie point is 57° C.

* * * * *